US006994904B2

(12) United States Patent
Joseph et al.

(10) Patent No.: US 6,994,904 B2
(45) Date of Patent: Feb. 7, 2006

(54) PRESSURE SENSITIVE ADHESIVE FIBERS WITH A REINFORCING MATERIAL

(75) Inventors: Eugene G. Joseph, Vadnais Heights, MN (US); Zhiming Zhou, Woodbury, MN (US); Randy A. Hoff, Hudson, WI (US); Albert I. Everaerts, Oakdale, MN (US); Wayne K. Dunshee, Maplewood, MN (US); Mary L. Brown, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 32 days.

(21) Appl. No.: 09/847,942

(22) Filed: May 2, 2001

(65) Prior Publication Data

US 2003/0026967 A1 Feb. 6, 2003

(51) Int. Cl.
*D02G 3/00* (2006.01)

(52) U.S. Cl. ..... 428/297.4; 428/292.1; 428/283; 428/284; 428/317.3; 428/343; 428/355; 428/903; 442/149; 442/200

(58) Field of Classification Search ..... 428/343, 428/284, 317.3, 292.1, 903, 355, 297.4, 283; 422/149; 442/200, 149; 427/207.1; 604/54, 604/41, 57

See application file for complete search history.

(56) References Cited

U.S. PATENT DOCUMENTS

| | | | | |
|---|---|---|---|---|
| 3,338,992 | A | 8/1967 | Kinney | 264/24 |
| 3,382,305 | A | 5/1968 | Breen | |
| 3,502,763 | A | 3/1970 | Hartmann | 264/210 |
| 3,575,782 | A | 4/1971 | Hansen | 442/329 |
| 3,692,618 | A | 9/1972 | Dorschner et al. | 161/72 |
| 4,405,297 | A | 9/1983 | Appel et al. | 425/72 |
| 4,554,324 | A | 11/1985 | Husman et al. | 128/640 |
| 4,737,559 | A | 4/1988 | Kellen et al. | 526/291 |
| 5,176,952 | A | 1/1993 | Joseph et al. | 428/284 |
| 5,215,087 | A | 6/1993 | Anderson et al. | 128/640 |
| 5,232,770 | A | 8/1993 | Joseph | 428/284 |
| 5,238,733 | A | 8/1993 | Joseph et al. | 428/224 |
| 5,248,455 | A | 9/1993 | Joseph et al. | 264/6 |
| 5,258,220 | A | 11/1993 | Joseph | 428/284 |
| 5,336,552 | A | 8/1994 | Strack et al. | 428/224 |
| 5,382,400 | A | 1/1995 | Pike et al. | 264/168 |
| 5,498,463 | A | 3/1996 | McDowall et al. | 428/198 |
| 5,506,279 | A | 4/1996 | Babu et al. | 522/34 |
| 5,512,358 | A | 4/1996 | Shawver et al. | 428/286 |
| 5,545,464 | A | 8/1996 | Stokes | 428/198 |
| 5,695,868 | A | 12/1997 | McCormack | 428/283 |
| 5,876,855 | A | 3/1999 | Wong et al. | 428/355 |
| 6,063,838 | A | 5/2000 | Patnode et al. | 523/172 |
| 6,083,856 | A | 7/2000 | Joseph et al. | 442/361 |
| 6,107,219 | A | 8/2000 | Joseph et al. | 442/361 |
| 6,171,985 | B1 | 1/2001 | Joseph et al. | 442/346 |

FOREIGN PATENT DOCUMENTS

| | | |
|---|---|---|
| WO | WO 91/16374 | 10/1991 |
| WO | WO 96/23915 | 8/1996 |
| WO | WO 96/25469 | 8/1996 |
| WO | WO 97/23577 | 7/1997 |
| WO | WO 99/28539 | 6/1999 |
| WO | WO 99/42536 | 8/1999 |

OTHER PUBLICATIONS

ASTM D 882-97, "Standard Test Method for Tensile Properties of Thin Plastic Sheeting," *Annual Book of ASTM Standards*, vol. 14.02, pp. 165-173 (1997).

ASTM D 3759/D 3759M-96, "Standard Test Method for Tensile Strength and Elongation of Pressure-Sensitive Tapes," *Annual Book of ASTM Standards*, vol. 14.02, pp. 434-439 (1996).

"Mixing in Single-Screw Extruders," in *Mixing in Polymer Processing*, Rauwendaal, ed., Marcel Dekker, Inc., New York, NY, Title Page, publication page, pp. 129, 176-177, and 185-186 (1991).

Wente, Van, et al., "Manufacture of Superfine Organic Fibers," Report No. 4364 of the Naval Research Laboratories, Title Page, Publication Page, Table of Contents, and pp. 1-15 (May 25, 1954).

Wente, Van, "Superfine Thermoplastic Fibers," *Industrial and Engineering Chemistry*, vol. 48, No. 8, pp. 1342-1346 (Aug. 1956).

U.S. Appl. No. 09/751,141, filed Dec. 29, 2000, Khandpur et al.

U.S. Appl. No. 09/764,540, filed Jan. 17, 2001, Landgrebe et al.

U.S. Appl. No. 09/764,478, filed Jan. 17, 2001, Zhou et al.

U.S. Appl. No. 09/762,155, filed Feb. 2, 2001, Bredhal et al.

U.S. Appl. No. 09/847,941, filed May 2, 2001, Dunshee.

U.S. Appl. No. 09/141,272, filed May 2, 2001, Dunshee et al.

U.S. Appl. No. 09/934,450, filed Aug. 21, 2001, Stebbings et al.

Product data sheet: "DDN: Bubble, Foam Packaging," DDN Industries, Inc., 2004 (1 pg) [retrieved on Jan. 22, 2004]. Retrieved from the Internet: <http: //ddn-industries.com/BubbleProducts.html>.

Product data sheet: "Frequently Asked Questions," datasheet [online]. Andover Coated Products, Inc., Salisbury, Massachusetts, (2 pgs) [retrieved on Jan. 22, 2004]. Retrieved from the Internet: <http://www.andoverfootball.com/faq.htm>.

(Continued)

*Primary Examiner*—Rena Dye
*Assistant Examiner*—Camie S. Thompson

(57) ABSTRACT

This invention is directed to a reinforced adhesive fiber that includes a pressure sensitive adhesive component and a reinforcing material within the pressure sensitive adhesive component.

34 Claims, No Drawings

OTHER PUBLICATIONS

Product data sheet: "Gospel Medical Cohesive Bandage," YueQing Gospel Medical Instrument Co.,ltd., Zhejiang Province, China 325604, 2003 (1 pg) [retrieved on Jan. 22, 2004]. Retrieved from the Internet: <http://www.gospel-medical.com/en/products/flexrip.htm>.

Product data sheet: "IPAC@LLNL—Technology Profile: Coating and Joining Technology," Lawrence Livermore National Laboratory, Livermore, CA, (Nov. 2001) (2 pgs) [retrieved on Jan. 22, 2004]. Retrieved from the Internet: >http://www.llnl.gov/IPandC/technology/profile/manufactuing/CoatingAndJoiningTechnology/index.php?textOnly=true>.

Product data sheet: "[Links] Cohesive Bandage and Adhesive Tape," links@highland.equiworld.com, Aug. 11, 2003 (1 pg) [retrieved on Jan. 22, 2004]. Retrieved from the Internet: >http://highland.equiworld.com.pipermail/links/Week-of-Mon-20030811/004267.html>.

Product data sheet: "Welcome to visit gospel medical," YueQing Gospel Medical Instrument Co.,ltd., Zhejiang Province, China 325604, 2003 (1 pg) [retrieved on Jan. 22, 2004]. Retrieved from the Internet: <http: //www.gospelmedical.com/index_e.html>.

Product data sheet: "Andover Football Main—Andover Coated Products, Inc.," datasheet [online]. Andover Coated Products, Inc., Salisbury, Massachusetts, (1 pg) [retrieved on Jan. 22, 2004]. Retrieved from the Internet: <http://www.andoverfootball.com/intro.htm>.

Product data sheet: "Athletic Tape, Underwrap, Cohesive Bandages," Wolverine Sports Football Equipment, Ann Arbor, MI (4 pgs) [retrieved on Jan. 22, 2004]. Retrieved from the Internet: <http://wolverinesports.com.football44.html>.

Product data sheet: "Buy Self-Adhesive Cohesive Bubble Wrap Dispenser—Brand Name: Intertape—Buy Office Products at RealEmall.com," RealEmall.com (2 pgs) [retrieved on Jan. 22, 2004]. Retrieved from the Internet: <http: //office-supply.realemall.com/Intertape/SelfAdhesive-Cohesive-Bubble-Wrap-Dispenser.asp>.

Product data sheet: "Cohesive bands," Stoffel Seals®, Stoffel Seals Corporation, Tallapoosa, GA, and Nyack, NY, 1999-2003 (2 pgs) [retrieved on Jan. 22, 2004]. Retrieved from the Internet: <http: //www.stoffel.com/Cohesives/Cohesives.html>.

PRESSURE SENSITIVE ADHESIVE FIBERS WITH A REINFORCING MATERIAL

FIELD OF THE INVENTION

The present invention relates to pressure sensitive adhesive fibers that can be used, for example, in a stretch removable adhesive article. In particularly preferred embodiments, the invention is directed to minimicrofibrous reinforced pressure sensitive adhesive fibers and methods for their preparation and use.

BACKGROUND OF THE INVENTION

Stretch removable adhesive articles are desirable for use in adhering to skin or delicate surfaces. Stretch removability occurs as a result of the selection of a stretch removable adhesive, i.e., one that has sufficient internal strength that it can be gripped and removed on its own even in the absence of a backing, or as a result of the selection of a stretch removable backing, i.e., a backing that allows a construction that includes a weaker adhesive to be removed by stretching.

Pressure sensitive adhesive tapes and the like are used in a wide variety of applications where there is a need to adhere to skin, for example, medical tapes, wound or surgical dressings, athletic tapes, surgical drapes, or tapes or tabs used in adhering medical devices such as sensors, electrodes, ostomy appliances, or the like. A concern with all these adhesive-coated products is the need to balance the objective of providing sufficiently high levels of adhesion to ensure that the pressure sensitive adhesive products do not fall off, while ensuring that the underlying skin or other delicate surface experiences a low amount of trauma, damage, pain, or irritation during use and/or removal. These goals are generally conflicting. Many approaches have been suggested to balance these conflicting goals; however, there still remains a need for products that effectively do so.

For example, film-backed, normally tacky, pressure sensitive adhesive tapes that are highly stretchy and elastic are known to be easily removed from a surface by stretching the tapes lengthwise in a direction substantially parallel to the plane of the surface. For such tapes the adhesion capability substantially disappears as the film is being stretched. If such tapes are too elastic, they may exhibit large recoil when the stretching force is removed, which can be undesirable. Additionally, highly elastic tapes tend to substantially recover their original shape when the stretching force is removed, and they are therefore not useful for indication of tampering or for guaranteeing single uses for hygienic purposes.

Such so-called "stretch release" or "stretch removable" adhesive constructions often include backings having stretchabilities that typically match those of the adhesives. Other backings of differing stretchability can be used by using a pre-reated/damaged backing having a strength that is inconsequential in the stretch removal process and an adhesive that is substantial enough to alone support the stretch removal process, i.e., a stretch removable adhesive. Although many of such constructions are useful, there is still a need for stretch removable adhesive articles, particularly those that can be easily removed from a surface such as skin or other delicate surface without a significant amount of pain, trauma, damage, or irritation.

Such stretch removable adhesive products preferably include a pressure sensitive adhesive. Pressure sensitive adhesives are generally characterized by their properties. Pressure sensitive adhesives are well known to one of ordinary skill in the art to possess properties including the following: (1) aggressive and permanent tack, (2) adherence to a substrate with no more than finger pressure, (3) sufficient ability to hold onto an adherend, and (4) sufficient cohesive strength to be removed cleanly from the adherend. Many pressure sensitive adhesives must satisfy these properties under an array of different stress and/or rate conditions. Additives may be included in the pressure sensitive adhesive to optimize such properties of the pressure sensitive adhesive. Care must be exercised in choosing additives that do not adversely affect one property (e.g., tack) while enhancing another (e.g., cohesive strength).

For certain adhesive articles, such as medical articles, it is desirable for the article to be breathable. The use of nonwoven webs of pressure sensitive adhesive fibers is one known method of accomplishing breathability. Fibers having a diameter of no greater than about 100 micrometers (microns), and particularly microfibers having a diameter of no greater than about 50 micrometers, have been developed for such uses. The fibers can be made by a variety of melt processes, including a spunbond process and a melt-blown process. In a spunbond process, fibers are extruded from a polymer melt stream through multiple banks of spinnerets onto a rapidly moving, porous belt, for example, forming an unbonded web. This unbonded web is then passed through a bonder, typically a thermal bonder, which bonds some of the fibers to neighboring fibers, thereby providing integrity to the web. In a melt-blown process, fibers are extruded from a polymer melt stream through fine orifices using high air velocity attenuation onto a rotating drum, for example, forming an autogenously bonded web. In contrast to a spunbond process, no further processing is necessary. Many melt-processed fibers, however, do not have adequate cohesive strength. This can result from the extreme conditions that can cause a breakdown of molecular weights of the polymers used to make the fibers.

What is desired is an adhesive fiber that has improved cohesive strength without losing the tackiness indicative of a pressure sensitive adhesive. In conjunction, it is desirable to create an adhesive fiber that is removable from a substrate with ease without losing the tackiness indicative of a pressure sensitive adhesive. Additionally, a pressure sensitive adhesive fiber that can be used in a stretch removable article, particularly a medical article, is desirable.

SUMMARY OF THE INVENTION

This invention is directed to an adhesive fiber (preferably, microfiber) that includes a pressure sensitive adhesive component and an organic polymeric reinforcing material within the pressure sensitive adhesive component. The reinforced adhesive fiber of the invention allows for an improved cohesive strength over the pressure sensitive adhesive component alone, yet the tack of the pressure sensitive adhesive remains substantially unreduced.

The present invention also provides stretch removable adhesive articles that include a backing and a pressure sensitive adhesive layer in the form of a nonwoven web, which includes such adhesive fibers, disposed thereon. Preferably, a nonwoven web of the adhesive fibers itself is stretch removable. Preferably, the adhesive fibers are suitable for use on skin and the adhesive article is in the form of a medical article, such as medical tapes, wound or surgical dressings, athletic tapes, surgical drapes, tapes or tabs used in adhering medical devices such as sensors, electrodes, ostomy appliances, and the like.

A nonwoven web of the adhesive fibers has a load at yield point and a maximum load. In one embodiment, the maximum load is at least about 30 grams/centimeter (g/cm) at a basis weight of about 55 grams/meter$^2$ (g/m$^2$) when tested according to ASTM D 3759-96 modified according to the procedure described in the Examples Section. In another embodiment, the maximum load is at least about 150% of the load at yield point at a basis weight of about 55 g/m$^2$ when tested according to ASTM D 3759-96 modified according to the procedure described in the Examples Section. In one embodiment, a nonwoven web of the adhesive fibers exhibits at least about 50% elongation at break at a basis weight of about 55 g/m$^2$ when measured according to ASTM D 3759-96 modified according to the procedure described in the Examples Section.

The reinforcing material can be in a variety of forms. Preferably, it is in the form of one or more fibers, particularly minimicrofibers, although it could be in the form of one or more layers, which can optionally alternate with layers of exposed pressure sensitive adhesive component. Minimicrofibers are preferred, at least because it is believed that this form contributes to enhanced stretch removable characteristics. In certain embodiments, the minimicrofibrous reinforcing material includes substantially continuous fibers within the pressure sensitive adhesive component.

In preferred embodiments, a nonwoven web of reinforced adhesive fiber according to the present invention, particularly minimicrofibrous reinforced adhesive fiber, will display stretch removable characteristics and easy removal from a substrate. Thus, the present invention provides stretch removable articles that include a fiber of the present invention.

The present invention also provides a pressure sensitive adhesive fiber that includes: a pressure sensitive adhesive component; and a reinforcing material that includes a metallocene-catalyzed polyolefin within the pressure sensitive adhesive component; wherein a nonwoven web that includes the pressure sensitive adhesive fiber and having a basis weight of about 55 g/m$^2$ has a maximum load of at least about 30 g/cm, which is at least about 150% of the load at yield point, and an elongation at break of at least about 50%.

In another embodiment, the present invention provides a pressure sensitive adhesive fiber that includes: a pressure sensitive adhesive component; and an organic polymeric reinforcing material within the pressure sensitive adhesive component, wherein the organic polymeric reinforcing material has a yield strength of no greater than about 20 MPa and an elongation at break of at least about 50%; wherein a nonwoven web that includes the pressure sensitive adhesive fiber and has a basis weight of about 55 g/m$^2$ has a maximum load of at least about 30 g/cm, which is at least about 150% of the load at yield point, and an elongation at break of at least about 50%.

Preferably, the pressure sensitive adhesive component includes a crosslinked acrylate copolymer, wherein the crosslinked acrylate copolymer includes copolymerized monomers including at least one monoethylenically unsaturated alkyl (meth)acrylate monomer, at least one monoethylenically unsaturated free-radically copolymerizable reinforcing monomer having a homopolymer glass transition temperature higher than that of the alkyl (meth)acrylate monomer. The crosslinked acrylate copolymer is preferably derived from a melt-processable acrylate copolymer and a crosslinking agent, wherein the crosslinking agent crosslinks subsequent to fiber formation or is a thermally reversible crosslinking agent.

A nonwoven web of the pressure sensitive adhesive fibers of the present invention can be disposed on a variety of substrates if desired, although a nonwoven web can be used as a free-standing adhesive. Examples of such substrates include a release liner. Other examples include an extensible nonwoven web that includes fibers having at least two substantially continuous layers throughout the fiber length, wherein the layers include at least one first layer of a low modules material and at least one second layer of a relatively nonelastic higher modulus material capable of undergoing substantial permanent deformation.

The present invention also provides a tape that includes: a backing having a first and second side; and a nonwoven web including the pressure sensitive adhesive fiber of the present invention disposed on at least a portion of the first side of the backing and, optionally, on at least a portion of the second side of the backing.

Medical articles are also provided that include a pressure sensitive adhesive fiber of the present invention. The medical article can be in the form of a wound dressing, surgical dressing, medical tape, athletic tape, or surgical tape. Alternatively, it can be in the form of a sensor, an electrode, or an ostomy appliance.

In addition, the invention is directed to a method for making minimicrofibrous reinforced fibers (preferably, microfibers). The method comprises forming a molten mixture that includes a pressure sensitive adhesive with a reinforcing material capable of forming minimicrofibers when subjected to a shear or extensional force, subjecting the molten mixture to the shear or extensional force, and quenching (e.g., by rapid cooling).

In this application, the following terms are defined as follows, unless otherwise stated:

"Fibers" typically have a diameter of no greater than about 100 micrometers.

"Microfibers" have a diameter of no greater than about 50 micrometers.

"Minimicrofibers" typically have a diameter of no greater than about 10 micrometers.

"Stretch removable" means that a pressure sensitive adhesive or article, when pulled and elongated (preferably from a substrate surface at a rate of 30 centimeters/minute and at an angle of no greater than 90°) detaches from a substrate surface without significant damage to the substrate surface (e.g., tearing), and without leaving a significant residue, preferably that which is visible to the unaided human eye on the substrate.

"Substantially continuous" means that for an at least 0.5 centimeter length sample of the adhesive fiber, at least 50% of the minimicrofibers present in the sample are continuous (i.e., they have the same length of the sample).

"Maximum load" is the maximum (tensile) load in a tensile elongation plot when tested according to ASTM D 3759-96 modified according to the procedure described in the Examples Section.

"Load at yield point" is the force measured at the yield point when tested according to ASTM D 3759-96 modified according to the procedure described in the Examples Section.

DETAILED DESCRIPTION OF PREFERRED EMBODIMENTS OF THE INVENTION

The present invention is directed to a reinforced adhesive fiber that includes a pressure sensitive adhesive component and an organic polymeric reinforcing material within the pressure sensitive adhesive component. The reinforced adhesive fiber of the present invention has improved cohesive strength, as represented by a higher tensile strength (in film form) as compared to the pressure sensitive adhesive fiber without the reinforcing material. Additionally, in a preferred embodiment, a nonwoven web that includes such adhesive fibers is stretch removable. The adhesive fiber of the invention has these properties while maintaining substantially unreduced tack properties in many embodiments.

The reinforced pressure sensitive adhesive fibers of the present invention typically have a diameter of no greater than about 100 micrometers and are useful in making coherent nonwoven webs that can be used in making a wide variety of products. Preferably, such fibers have a diameter of no greater than about 50 micrometers, and often, no greater than about 25 micrometers. Fibers of no greater than about 50 micrometers are often referred to as "microfibers."

The reinforcing material can be in a variety of forms. Preferably, it is in the form of one or more fibers, although it could be in the form of one or more layers, which can optionally alternate with layers of exposed pressure sensitive adhesive component. In preferred embodiments, the fibers are reinforced with much smaller fibers, the latter of which are preferably continuous fibers. The smaller reinforcing fibers typically have a diameter of no greater than about 10 micrometers, and preferably no greater than about 5 micrometers. Such fibrous material is referred to herein as "minimicrofibrous" and includes "minimicrofibers."

Minimicrofibers are a particularly preferred form of the reinforcing material, at least because it is believed that this form contributes to enhanced stretch removable characteristics. In certain embodiments, the minimicrofibrous reinforcing material includes substantially continuous fibers within the pressure sensitive adhesive component.

In the present invention, a nonwoven web of the pressure sensitive adhesive fibers with organic polymeric reinforcing material therein has a load at yield point, a maximum load, and an elongation at break. These properties define a material that is stretch removable, and preferably imparts to underlying skin or other delicate surface a low amount of trauma, damage, pain, or irritation during use and/or removal. For such a material to be stretch removable, it is preferred that the reinforcing material be in the form of fibers (e.g., minimicrofibers or larger fibers as in a reinforcing core/adhesive shell fiber) or one or more layers, optionally alternating with one or more layers of the pressure sensitive adhesive component. It is further believed that discrete droplets, for example, would not provide such properties.

A nonwoven web of the pressure sensitive adhesive fibers with organic polymeric reinforcing material therein, preferably in the form of minimicrofibers, preferably has a maximum load of at least about 30 g/cm at a basis weight of about 55 g/m$^2$ when measured according to ASTM D 3759-96 modified according to the procedure described in the Examples Section. In more preferred embodiments, the maximum load is at least about 50 g/cm at a basis weight of about 55 g/m$^2$ when measured according to ASTM D 3759-96 modified according to the procedure described in the Examples Section. In most preferred embodiments, the maximum load is at least about 60 g/cm at a basis weight of about 55 g/m$^2$ when measured according to ASTM D 3759-96 modified according to the procedure described in the Examples Section. For nonwoven webs, these values are typically measured in the machine direction.

In preferred embodiments, the load at yield point of a nonwoven web of the pressure sensitive adhesive fibers with organic polymeric reinforcing material therein is no greater than about 100 g/cm at a basis weight of about 55 g/m$^2$ when measured according to ASTM D 3759-96 modified according to the procedure described in the Examples Section. In more preferred embodiments, the load at yield point is no greater than about 40 g/cm at a basis weight of about 55 grams/meter$^2$ (g/m$^2$) when measured according to ASTM D 3759-96 modified according to the procedure described in the Examples Section. In most preferred embodiments, the load at yield point is no greater than about 5 g/cm at a basis weight of about 55 grams/meter$^2$ (g/m$^2$) when measured according to ASTM D 3759-96 modified according to the procedure described in the Examples Section. For nonwoven webs, these values are typically measured in the machine direction.

Additionally, a nonwoven web of the pressure sensitive adhesive fibers with organic polymeric reinforcing material therein preferably has a maximum load of at least about 150%, more preferably at least about 200%, and most preferably at least about 300%, of the load at yield point, at a basis weight of about 55 g/m$^2$ when measured according to ASTM D 3759-96 modified according to the procedure described in the Examples Section.

For preferred embodiments, the elongation at break for a nonwoven web of the pressure sensitive adhesive fibers with organic polymeric reinforcing material therein is at least about 50%, more preferably at least about 200%, and most preferably at least about 300%, at a basis weight of about 55 g/m$^2$ when measured according to ASTM D 3759-96 modified according to the procedure described in the Examples Section. In some embodiments the elongation at break is in excess of about 500%. For nonwoven webs, these values are typically measured in the machine direction.

The adhesive fibers are used in adhesive articles that may include a backing having a pressure sensitive adhesive layer disposed on at least one major surface thereof. Preferably, the adhesive articles are stretch removable. Preferably, the adhesive articles are designed for use on skin or other delicate surfaces with no significant damage to the skin or other delicate surface, and if the surface is skin, there is little or no pain upon removal of the adhesive article.

Preferably, such adhesive articles are tapes that include gauze pads, for example, and are used as first aid dressings (i.e., wound or surgical dressings). The adhesive articles can be in the form of a wide variety of other medical articles, such as medical tapes, athletic tapes, surgical drapes, or tapes or tabs used in adhering medical devices such as sensors, electrodes (as disclosed in U.S. Pat. No. 5,215,087 (Anderson et al.), and U.S. Pat. No. 6,171,985 (Joseph et al.), for example), ostomy appliances, or the like. Adhesive articles of the present invention can also be in the form of a variety of sheeting products (e.g., decorative, reflective, and graphical), removable labels, coupons, masking tapes, tapes or tabs used in adhering diapers, packaging, food storage containers, etc. They can be used in tamper-indicating applications, particularly if upon stretching, the adhesive articles do not recover their original shape. Preferred embodiments, however, are medical articles such as those described in Applicants' Assignee's copending U.S. patent application Ser. No. 09/764540, entitle "Stretch Removable Adhesive Articles and Methods," filed on Jan. 17, 2001, and U.S. patent application Ser. No. 09/847,941, entitle "Tapered Stretch Removable adhesive Articles and Methods," filed on even date herewith.

Pressure Sensitive Adhesive Component

A wide variety of pressure sensitive adhesives can be used for this invention as the pressure sensitive adhesive component of the adhesive fiber. Furthermore, the pressure sensitive adhesive component can be a single pressure sensitive adhesive or it can be a combination of two or more pressure sensitive adhesives. The pressure sensitive adhesive component can be a wide variety of materials that have pressure sensitive adhesive properties and are capable of being extruded and forming fibers in a melt process (i.e., that are melt-processable), such as a spunbond process or a melt-blown process, without substantial degradation or gelling. That is, suitable materials are those that have a relatively low viscosity in the melt such that they can be readily extruded.

Such materials preferably have an apparent viscosity in the melt (i.e., at melt processing conditions) in a range of about 150 poise to about 1500 poise, as measured by either capillary rheometry or cone and plate rheometry. Preferred materials are those that are capable of forming fibers in a melt-blown process with few, if any, breaks during web formation. That is, preferred materials have an extensional viscosity that allows them to be drawn effectively into fibers.

Fibers formed from suitable materials have sufficient cohesive strength and integrity at their use temperature such that a nonwoven web formed therefrom maintains its fibrous structure. Sufficient cohesiveness and integrity typically depends on the inherent viscosity of the pressure sensitive adhesive component. Typically, sufficient cohesiveness and integrity occur in materials having an inherent viscosity of at least about 0.4, preferably, about 0.4 to about 1.5, and more preferably, about 0.4 to about 0.8, as measured by conventional means using a Cannon-Fenske #50 viscometer in a water bath controlled at 25° C. to measure the flow time of 10 milliliters of a polymer solution (0.2 grams per deciliter polymer in ethyl acetate). Fibers that include suitable pressure sensitive adhesive components also have relatively low or no cold flow, and display good aging properties, such that the fibers maintain their shape and adhesive properties over an extended period of time under ambient conditions.

Pressure sensitive adhesives useful in the present invention include, for example, those based on synthetic rubbers, styrene block copolymers, polyvinyl ethers, poly(meth)acrylates (including both acrylates and methacrylates), polyolefins, and silicones. Combinations of these adhesives can be used in the pressure sensitive adhesive component.

The pressure sensitive adhesive may be inherently tacky. If desired, tackifiers may be added to a base material to form the pressure sensitive adhesive. Useful tackifiers include, for example, rosin ester resins, aromatic hydrocarbon resins, aliphatic hydrocarbon resins, mixed aromatic/aliphatic hydrocarbon resins, and terpene resins. Other materials can be added for special purposes, including, for example, oils, plasticizers, antioxidants, ultraviolet ("UV") stabilizers, hydrogenated butyl rubber, pigments, curing agents, and crosslinkers as described below.

In a preferred embodiment, the pressure sensitive adhesive is based on at least one poly(meth)acrylate (i.e., a (meth)acrylic pressure sensitive adhesive). Particularly preferred poly(meth)acrylates are derived from: (A) at least one monoethylenically unsaturated alkyl (meth)acrylate monomer (i.e., alkyl acrylate and alkyl methacrylate monomer); and (B) at least one monoethylenically unsaturated free-radically copolymerizable reinforcing monomer. The reinforcing monomer has a homopolymer glass transition temperature (Tg) higher than that of the alkyl (meth)acrylate monomer and is one that increases the glass transition temperature and cohesive strength of the resultant copolymer. Monomers A and B are chosen such that a copolymer formed from them is extrudable and capable of forming fibers. Herein, "copolymer" refers to polymers containing two or more different monomers, including terpolymers, tetrapolymers, etc.

Preferably, the monomers used in preparing the pressure sensitive adhesive component of the fibers of the present invention include: (A) a monoethylenically unsaturated alkyl (meth)acrylate monomer that, when homopolymerized, generally has a glass transition temperature (Tg) of no greater than about 0° C.; and (B) a monoethylenically unsaturated free-radically copolymerizable reinforcing monomer that, when homopolymerized, generally has a glass transition temperature of at least about 10° C. The glass transition temperatures of the homopolymers of monomers A and B are typically accurate to within 5° C. and are measured by differential scanning calorimetry.

Monomer A, which is a monoethylenically unsaturated alkyl acrylate or methacrylate (i.e., (meth)acrylic acid ester), contributes to the flexibility and tack of the copolymer of the adhesive component of the fibers. Preferably, monomer A has a homopolymer Tg of no greater than about 0° C. Preferably, the alkyl group of the (meth)acrylate has an average of about 4 to about 20 carbon atoms, and more preferably, an average of about 4 to about 14 carbon atoms. The alkyl group can optionally contain oxygen atoms in the chain thereby forming ethers or alkoxy ethers, for example. Examples of monomer A include, but are not limited to, 2-methylbutyl acrylate, isooctyl acrylate, lauryl acrylate, 4-methyl-2-pentyl acrylate, isoamyl acrylate, sec-butyl acrylate, n-butyl acrylate, n-hexyl acrylate, 2-ethylhexyl acrylate, n-octyl acrylate, n-decyl acrylate, isodecyl acrylate, isodecyl methacrylate, and isononyl acrylate. Other examples include, but are not limited to, poly-ethoxylated or -propoxylated methoxy (meth)acrylates such as acrylates of CARBOWAX (commercially available from Union Carbide) and NK ester AM90G (commercially available from Shin Nakamura Chemical, Ltd., Japan). Preferred monoethylenically unsaturated (meth)acrylates that can be used as monomer A include isooctyl acrylate, 2-ethyl-hexyl acrylate, and n-butyl acrylate. Combinations of various monomers categorized as an A monomer can be used to make the copolymer used in making the fibers of the present invention.

Monomer B, which is a monoethylenically unsaturated free-radically copolymerizable reinforcing monomer, increases the glass transition temperature and cohesive strength of the copolymer. Preferably, monomer B has a homopolymer Tg of at least about 10° C. More preferably, monomer B is a reinforcing (meth)acrylic monomer, including an acrylic acid, a methacrylic acid, an acrylamide, or a (meth)acrylate. Examples of monomer B include, but are not limited to, acrylamides, such as acrylamide, methacrylamide, N-methyl acrylamide, N-ethyl acrylamide, N-hydroxyethyl acrylamide, diacetone acrylamide, N,N-dimethyl acrylamide, N,N-diethyl acrylamide, N-ethyl-N-aminoethyl acrylamide, N-ethyl-N-hydroxyethyl acrylamide, N,N-dihydroxyethyl acrylamide, t-butyl acrylamide, N,N-dimethylaminoethyl acrylamide, and N-octyl acrylamide. Other examples of monomer B include itaconic acid, crotonic acid, maleic acid, fumaric acid, 2,2-(diethoxy)ethyl acrylate, 2-hydroxyethyl acrylate or methacrylate, 3-hydroxypropyl acrylate or methacrylate, methyl methacrylate, isobornyl acrylate, 2-(phenoxy)ethyl acrylate or methacrylate, biphenylyl acrylate, t-butylphenyl acrylate, cyclohexyl acrylate, dimethyladamantyl acrylate, 2-naphthyl acrylate, phenyl acrylate, N-vinyl formamide, N-vinyl acetamide, N-vinyl pyrrolidone, and N-vinyl caprolactam. Preferred reinforcing acrylic monomers that can be used as monomer B include acrylic acid and acrylamide. Combinations of various reinforcing monoethylenically unsaturated monomers categorized as a B monomer can be used to make the copolymer used in making the fibers of the present invention.

The preferred acrylate copolymer is formulated to have a resultant Tg of less than about 25° C. and more preferably, less than about 0° C. Such acrylate copolymers preferably include about 60 parts to about 98 parts per hundred of at least one monomer A and about 2 parts to about 40 parts per hundred of at least one monomer B. Preferably, the acrylate copolymers have about 85 parts to about 98 parts per hundred or at least one monomer A and about 2 parts to about 15 parts of at least one monomer B.

A crosslinking agent can be used if so desired to build the molecular weight and the strength of the copolymer of the adhesive component of the fibers, and hence improve the integrity and shape of the fibers. Preferably, the crosslinking agent is one that is copolymerized with monomers A and B. The crosslinking agent may produce chemical crosslinks (e.g., covalent bonds or ionic bonds). Alternatively, it may produce thermal reversible physical crosslinks that result, for example, from the formation of reinforcing domains due to phase separation of hard segments (i.e., those having a Tg higher than room temperature, preferably higher than 70° C.) and/or acid/base interactions (i.e., those involving functional groups within the same polymer or between polymers or between a polymer and an additive). Preferred crosslinking occurs through the use of macromers, such as the styrene macromers of U.S. Pat. No. 4,554,324 (Husman et al.), or polymeric ionic crosslinking as described in WO 99/42536. Suitable crosslinking agents are also disclosed in U.S. Pat. No. 4,737,559 (Kellen et al.), U.S. Pat. No. 5,506,279 (Babu et al.), and U.S. Pat. No. 6,083,856 (Joseph et al.).

Reinforcing Material

Various organic polymeric reinforcing materials can be used to practice the present invention. In preferred embodiments, the reinforcing material is an organic elastomeric material. Preferably, the reinforcing material includes a semi-crystalline polymer. A semi-crystalline polymer is one having both amorphous and crystalline domains. Many specific embodiments incorporate semi-crystalline polymers, such as polycaprolactone (PCL), polybutene (PB), copolymers derived from ethylene and at least one other alpha-olefin monomer (e.g., poly(ethylene-co-1-alkene) and poly(ethylene-co-1-alkene-co-1-alkene), such as metallocene-catalyzed polyolefin polymers ENGAGE 8400 commercially available from DuPont Dow Elastomers and EXACT 4023, EXACT 3040, and EXACT 3024, all of which are commercially available from ExxonMobil Co.), ultra low density polyethylene (e.g., having a density below 0.915 grams/cubic centimeter, such as ATTANE 4202 commercially available from Dow Chemical Co.), linear low density polyethylene (e.g., having a density between 0.915 and 0.94 grams/cubic centimeter, such as LL-3003, ECD-125, 377D60, 369G09, 363C32, 361C33, 357C32, 350D65, 350D64, 350D60, LL-3013, and LL-3001 commercially available from ExxonMobil Corp., and ASPUN 6806 commercially available from Dow Chemical Co.), or combinations thereof. Preferred reinforcing material includes one or more metallocene-catalyzed polyolefins, such as copolymers derived from ethylene and at least one other alpha-olefin monomer.

In certain embodiments, the yield strength of the reinforcing material in film form is preferably no greater than about 20 megapascals (MPa), more preferably, no greater than about 15 MPa, and most preferably, no greater than about 10 MPa. The elongation at break of the reinforcing material in film form is preferably at least about 50%, more preferably at least about 200%, and most preferably at least about 300%. The tensile strength of the reinforcing material in film form is preferably at least about 150% of its yield strength. In specific embodiments, the tensile strength of the reinforcing material is higher than the tensile strength of the pressure sensitive adhesive. These values are measured using ASTM D 882-97 at a crosshead speed of 12 inches/minute (30 centimeters/minute).

The reinforcing material preferably has a melting point above the use temperature of the adhesive fiber. Similarly, the reinforcing material preferably has a melting point above the storage temperature of the adhesive fiber or any article manufactured with the adhesive fiber. Both the use temperature and the storage temperature should not exceed the temperature at which the pressure sensitive adhesive component decomposes.

The reinforcing material is typically in the form of fibers, particularly minimicrofibers, or layers. For certain embodiments in which fibrous reinforcing material is desired, particularly minimicrofibrous reinforcing material, the reinforcing material is preferably immiscible (i.e., remains in a separate phase) in the pressure sensitive adhesive component during mixing so that the reinforcing material can be substantially uniformly dispersed (i.e., distributed) in the pressure sensitive adhesive component. In specific embodiments, during mixing, the reinforcing material is in the form of substantially spherical particles having an average diameter of less than about 20 micrometers. In certain embodiments, the reinforcing material has an average diameter of less than about 10 micrometers.

In preferred embodiments, the reinforcing material exists as substantially continuous minimicrofibers inside an adhesive fiber. Specifically, according to one aspect of the invention, in an at least 0.5 centimeter length fiber sample (and preferably, up to an 8 centimeter length fiber sample), at least 50% of the minimicrofibers present in the fiber sample are continuous (i.e., they have the same length of the sample). According to another aspect of the invention, the substantially continuous minimicrofibers generally have a maximum diameter of about 0.05 micrometer to about 5 micrometers, preferably from about 0.1 micrometer to about 1 micrometer. According to another aspect of the invention, the aspect ratio (i.e., the ratio of the length to the diameter) of the substantially continuous minimicrofibers is greater than about 1000.

Preferred combinations of adhesive component and reinforcing material include a poly(meth)acrylate pressure sensitive adhesive component reinforced with a metallocene-catalyzed polyolefin, such as a copolymer derived from ethylene and at least one other alpha-olefin monomer. Particularly preferred reinforcing material is in the form of minimicrofibers. Although conjugate fibers containing a poly(meth)acrylate pressure sensitive adhesive and a polyolefin are disclosed by U.S. Pat. No. 6,083,856 (Joseph et al.), there is no specific disclosure of the polyolefin being a metallocene-catalyzed copolymer. Significantly, there is no recognition that such a combination would have the desirable property of stretch removability, and preferably easy removability from a surface such as skin or other delicate surface without a significant amount of pain, trauma, damage, or irritation.

Particularly preferred reinforcing material is in the form of minimicrofibers. Although conjugate fibers are disclosed by U.S. Pat. No. 6,083,856 (Joseph et al.), there is no specific disclosure of a reinforcing material in the form of minimicrofibers. Significantly, there is no recognition that such a reinforcing material would have the desirable property of stretch removability, and preferably easy removability from a surface such as skin or other delicate surface without a significant amount of pain, trauma, damage, or irritation.

Preparation of Fibers and Nonwoven Webs

For certain embodiments in which fibrous reinforcing material is desired, the reinforcing material is mixed with the pressure sensitive adhesive before subjecting the mixture to a shear force (i.e., a fluid is sheared when velocity differences in normal direction occur in the fluid) and/or extensional force (i.e., extensional deformation of a fluid occurs when the velocity changes in the direction of flow). Mixing of the reinforcing material and the pressure sensitive adhesive is done by any method that results in a dispersion, preferably a substantially uniform dispersion, of the reinforcing material in the pressure sensitive adhesive. For example, melt blending, solvent blending, or any suitable physical means are able to adequately mix the reinforcing material and the pressure sensitive adhesive component.

Melt blending devices include those that provide dispersive mixing, distributive mixing, or a combination of dispersive and distributive mixing. Both batch and continuous methods of melt blending can be used. Examples of batch methods include those using a BRABENDER (e.g., a BRABENDER PREP CENTER, commercially available from C.W. Brabender Instruments, Inc., South Hackensack, N.J.) or BANBURY internal mixing and roll milling equipment (e.g., equipment available from Farrel Co., Ansonia, Conn.). After batch mixing, the mixture created may be immediately quenched and stored below melting temperature of the mixture for later processing.

Examples of continuous methods include single screw extruding, twin screw extruding, disk extruding, reciprocating single screw extruding, and pin barrel single screw extruding. The continuous methods can include utilizing both distributive elements, such as cavity transfer mixers (e.g., CTM, commercially available from RAPRA Technology, Ltd., Shrewsbury, England) and pin mixing elements, static mixing elements or dispersive mixing elements (e.g., MADDOCK mixing elements or SAXTON mixing elements as described in "Mixing in Single-Screw Extruders," *Mixing in Polymer Processing,* edited by Chris Rauwendaal (Marcel Dekker Inc.: New York (1991), pp. 129, 176–177, and 185–186).

Melt processes for the preparation of fibers are well-known in the art. For example, such processes are disclosed in Wente, "Superfine Thermoplastic Fibers," in *Industrial Engineering Chemistry,* Vol. 48, pages 1342 et seq. (1956); Report No. 4364 of the Naval Research Laboratories, published May 25, 1954, entitled "Manufacture of Superfine Organic Fibers" by Wente et al.; as well as in International Publication No. WO96/23915, and U.S. Pat. No. 3,338,992 (Kinney), U.S. Pat. No. 3,502,763 (Hartmann), U.S. Pat. No. 3,692,618 (Dorschner et al.), and U.S. Pat. No. 4,405,297 (Appel et al.). Such processes include both spunbond processes and melt-blown processes. A preferred method for the preparation of fibers, particularly microfibers, and nonwoven webs thereof, is a melt-blown process. For example, nonwoven webs of multilayer microfibers and melt-blown processes for producing them are disclosed in U.S. Pat. No. 5,176,952 (Joseph et al.), U.S. Pat. No. 5,232,770 (Joseph), U.S. Pat. No. 5,238,733 (Joseph et al.), U.S. Pat. No. 5,258,220 (Joseph), U.S. Pat. No. 5,348,455 (Joseph et al.), and U.S. Pat. No. 6,083,856 (Joseph et al.). These and other melt processes can be used in the formation of the nonwoven webs of the present invention.

Melt-blown processes are particularly preferred because they form autogenously bonded nonwoven webs that typically require no further processing to bond the fibers together. The melt-blown processes used in the formation of multilayer microfibers as disclosed in the Joseph et al. patents listed above are particularly suitable for use in making the fibers of the present invention. Such processes use hot (e.g., equal to or about 20° C. to about 30° C. higher than the polymer melt temperature), high-velocity air to draw out and attenuate extruded polymeric material from a die, which will generally solidify after traveling a relatively short distance from the die. The resultant fibers are termed melt-blown fibers and are generally substantially continuous. They form into a coherent nonwoven web between the exit die orifice and a collecting surface by entanglement of the fibers due in part to the turbulent airstream in which the fibers are entrained.

For example, U.S. Pat. No. 5,238,733 (Joseph et al.) describes forming a multicomponent melt-blown microfiber web by feeding two separate flow streams of organic polymeric material into a separate splitter or combining manifold. The split or separated flow streams are generally combined immediately prior to the die or die orifice. The separate flow streams are preferably established into melt streams along closely parallel flow paths and combined where they are substantially parallel to each other and the flow path of the resultant combined multilayered flow stream. This multilayered flow stream is then fed into the die and/or die orifices and through the die orifices. Air slots are disposed on either side of a row of the die orifices directing uniform heated air at high velocities at the extruded multicomponent melt streams. The hot high velocity air draws and attenuates the extruded polymeric material, which solidifies after traveling a relatively short distance from the die. Single layer microfibers can be made in an analogous manner with air attenuation using a single extruder, no splitter, and a single port feed die.

The solidified or partially solidified fibers form an interlocking network of entangled fibers, which are collected as a coherent web. The collecting surface can be a solid or perforated surface in the form of a flat surface or a drum, a moving belt, or the like. If a perforated surface is used, the backside of the collecting surface can be exposed to a vacuum or low-pressure region to assist in the deposition of the fibers. The collector distance is generally about 7 centimeters (cm) to about 130 cm from the die face. Moving the collector closer to the die face, e.g., about 7 cm to about 30 cm, will result in stronger inter-fiber bonding and a less lofty web.

The temperature of the separate polymer flowstreams is typically controlled to bring the polymers to substantially similar viscosities. When the separate polymer flowstreams converge, they should generally have an apparent viscosity in the melt (i.e., at melt blowing conditions) of about 150 poise to about 1500 poise, as determined using a capillary rheometer. The relative viscosities of the separate polymeric flowstreams to be converged should generally be fairly well matched.

The size of the polymeric fibers formed depends to a large extent on the velocity and temperature of the attenuating airstream, the orifice diameter, the temperature of the melt stream, and the overall flow rate per orifice. Typically, fibers having a diameter of no greater than about 10 micrometers can be formed, although coarse fibers, e.g., up to about 50 micrometers or more, can be prepared using a melt-blown process, and up to about 100 micrometers can be prepared using a spun bond process. The webs formed can be of any suitable thickness for the desired and intended end use. Generally, a thickness of about 0.01 cm to about 5 cm is suitable for most applications.

Typically, the organic polymeric reinforcing material is present in an amount of at least about 2 weight percent, and preferably at least about 5 weight percent, of the total weight of the adhesive fiber. Typically, the organic polymeric reinforcing material is present in an amount of no greater than about 40 weight percent, and preferably no greater than about 25 weight percent, of the total weight of the adhesive fiber. Typically, the pressure sensitive adhesive component is present in an amount of at least about 60 weight percent, and preferably, at least about 75 weight percent, of the total weight of the adhesive fiber. Typically, the pressure sensitive adhesive component is present in an amount of no greater than about 98 weight percent, and preferably, no greater than about 95 weight percent, of the total weight of the adhesive fiber.

Other additives may also be mixed into the pressure sensitive adhesive fiber prior to application thereof, depending on the desired properties of the applied adhesive.

Backings

To form a tape, a nonwoven web of reinforced adhesive fibers of the present invention is applied to at least a portion of a suitable backing. A release material (e.g., low adhesion backsize) can be applied to the opposite side of the backing, if desired. When double-coated tapes are formed, the reinforced adhesive fiber is applied, for example by co-extrusion or lamination, onto at least a portion of both sides of the backing. Additionally, the adhesive can be applied on at least one release liner to form a transfer tape.

Typically, the backing can be in the form of a web or film. In specific embodiments, the backing is stretchable so that an article that includes a nonwoven web of adhesive fibers of the present invention and the backing would be stretch removable.

Preferably, webs made from natural or synthetic fibers or mixtures thereof can be used to form backings, particularly for medical articles. Woven or nonwoven materials can be employed for webs, with nonwoven materials being preferred for most applications. Melt-blown or spunbond techniques can be employed to make such nonwoven webs, as described above for the adhesive fibers. Nonwoven webs can also be prepared, for example, on a RANDO WEBBER (Rando Corp., Macedon, N.Y.) air-laying machine or on a carding machine. Generally, the fibers are 100 micrometers or less in diameter when formed by melt spinning type processes, preferably 50 micrometers or less.

Multicomponent fibers, if formed by the melt-blown process, can be produced as described in U.S. Pat. No. 5,176,952 (Joseph et al.); U.S. Pat. No. 5,232,770 (Joseph); U.S. Pat. No. 5,238,733 (Joseph et al.); U.S. Pat. No. 5,258,220 (Joseph); or U.S. Pat. No. 5,248,455 (Joseph et al.). Multicomponent fibers can also be produced by a spunbond process as disclosed in U.S. Pat. No. 5,695,868 (McCormack); U.S. Pat. No. 5,336,552 (Strack et al.); U.S. Pat. No. 5,545,464 (Stokes); U.S. Pat. Nos. 5,382,400; 5,512,358 (Shawver et al.); or U.S. Pat. No. 5,498,463 (McDowall et al.).

Representative examples of materials suitable for the backing (whether in web or film form) of the adhesive article of this invention include polyolefins, such as polyethylene, including high density polyethylene, low density polyethylene, linear low density polyethylene, and linear ultra low density polyethylene, metallocene-catalyzed polyolefins, polypropylene, and polybutylenes; vinyl copolymers, such as polyvinyl chlorides, both plasticized and unplasticized, and polyvinyl acetates; olefinic copolymers, such as ethylene/methacrylate copolymers, ethylene/vinyl acetate copolymers, acrylonitrile-butadiene-styrene copolymers, and ethylene/propylene copolymers; acrylic polymers and copolymers; polycaprolactones; and combinations of the foregoing. Mixtures or blends of any plastic or plastic and elastomeric materials such as polypropylene/polyethylene, polyurethane/polyolefin, polyurethane/polycarbonate, polyurethane/polyester, can also be used. Additionally, any non-stretchable material can be used for the tearable backings or for those with perforations, including paper and even metal. Preferred materials for the backing include polyurethane, polypropylene, ethylene vinyl acetate, or combinations thereof (e.g., blends, mixtures, etc.) in the form of melt-blown fibers. Preferred materials for film backings include polycaprolactones and copolymers of ethylene/vinyl acetate and linear low density polyethylene.

A preferred backing is one that includes an extensible nonwoven web made of fibers, preferably melt-blown microfibers. Each of the fibers have at least two substantially continuous layers throughout the fiber length. The layers include at least one first layer of a low modules material and at least one second layer of a relatively nonelastic higher modulus material capable of undergoing substantial permanent deformation. Examples of such backings are described in U.S. Pat. No. 6,107,219 (Joseph et al.). Preferably, the layers are concentric or longitudinally layered. In certain embodiments, the fibers include an outer sheath layer that includes the at least one first layer and at least one internal core layer comprising the at least one second layer. Examples of materials suitable for the outer sheath layer include a polyurethane, metallocene-catalyzed polyolefins, and A-B-A block copolymers, such as KRATON copolymers available from Shell Chemical Ltd.; Houston, Tex., as well as blends thereof. Examples of materials suitable for the internal core layer include polyolefins, polyesters, ethylene vinyl acetate, as well as blends thereof. A preferred internal core layer is a blend of polyethylenes, preferably a linear low density polyethylene and a metallocene-catalyzed polyolefin, preferably in a ratio of 50:50.

If the backing is in the form of a laminate, additional components could be used, such as absorbent layers (e.g., gauze pads) for adhesive bandage products, or the like. If absorbent layers are used, they are typically thin, coherent, conformable, and able to flex and not interfere with the stretch removable characteristics of the articles, although they can be stretchable or not. If a laminate, there may be one or more additional layers. Preferably, the outermost layer of such a laminate is a film that is substantially impervious to fluids, such as could arise from the external environment, yet permits passage of moisture vapor such that the adhesive article is breathable (typically, having a moisture vapor transmission rate (MVTR) of at least about 500 $g/m^2/day$). Typically this breathable, liquid impervious film is the outermost (i.e., top) layer. Examples of such film materials include polyurethanes, polyolefins, metallocene-catalyzed polyolefins, polyesters, polyamides, polyetheresters, and A-B-A block copolymers, such as KRATON copolymers available from Shell Chemical Ltd., Houston, Tex.

EXAMPLES

This invention is further illustrated by the following examples that are not intended to limit the scope of the invention. These examples are merely for illustrative purposes only and are not meant to be limiting on the scope of the appended claims. All parts, percentages, portions, ratios, etc. in the examples and the rest of the specification are by weight unless indicated otherwise.

Test Protocols

For the tests reported herein, an INSTRON (model number 1122) materials tester (Instron Co., Canton, Mass.) with a gauge length of 5.08 cm (2 inches) was used. For each example, data was collected and reported as an average of 3 samples. Data was reported as along machine direction (MD) for the web or in cross direction (CD) for the web. The following test methods with test parameters and modifications for pressure sensitive and nonwoven materials were used for evaluation purposes in the examples.

For the adhesive melt blowing process, the method used was taken from Example 1 of U.S. Pat. No. 6,083,856 column 13, lines 20–26, except as noted in Examples 1 through 14.

Adhesive Load at Yield Point (of a Nonwoven Web): ASTM Test Method No. D3759-96 was followed using a sample of width of 2.5 cm, a gauge length of 5 cm and a crosshead speed of 25 or 30 centimeter/minute (cm/min) as noted in Table 1 and 4. Reported is the force recorded at the yield point on the force elongation curve.

Adhesive Elongation at Break (of a Nonwoven Web): ASTM Test Method No. D3759-96 was followed using a sample of width of 2.5 cm, a gauge length of 5 cm and a crosshead speed of 25 or 30 cm/min. Reported is the maximum percent of stretch reached by the test sample at point of break. Break or web failure is defined as the point after maximum force has been attained and followed by an irreversible decrease of force.

Adhesive Maximum Load (of a Nonwoven Web): ASTM Test Method No. D3759-96 was followed using a sample of width of 2.5 cm, a gauge length of 5 cm and a crosshead speed of 30 cm/min as noted in Table 4. Reported is the maximum force at or prior to the point of break or web failure. Break or web failure is defined as the point after maximum force has been attained and followed by an irreversible decrease of force.

Nonadhesive Maximum Load (of a Nonwoven Web): ASTM Test Method No. D3759-96 was followed using a dog bone shaped sample with a width of 0.31 cm, a gauge length of 1 cm was tested using a crosshead speed of 5 cm/min. Reported is the maximum force recorded at or prior to the point of break or web failure. Break or web failure is defined as the point after maximum force has been attained and followed by an irreversible decrease of force.

Nonadhesive Elongation at Break (of a Nonwoven Web): ASTM Test Method No. D3759-96 was followed using a dog bone shaped sample with a width of 0.31 cm, a gauge length of 1 cm was tested at a crosshead speed of 5 cm/min. Reported is the elongation in percent at web failure. Break or web failure is defined as the point after maximum force has been attained and followed by an irreversible decrease of force.

Permanent Set: The permanent set behavior of the melt-blown PSA webs were studied by subjecting the webs (5 cm gauge length, 2.5 cm width) to a 100% elongation at a 25 cm/min crosshead speed. The sample was then brought back to it's original gauge length (i.e., initial jaw gap distance of 5 cm) at the same crosshead speed. The elongation at which the force reached a value of zero during the recovery part of the experiment was taken as the permanent set. Data was collected as a percent of the initial length of the sample.

Stretch Release Force: A test specimen with a 7.5 cm length, 2.5 cm width and a 0.3 cm center tab was applied to a clean stainless steel test plate. A 2.04 kg rubber roll was passed over the specimen twice to ensure good contact with the test plate. The tab was clamped to the jaw of an INSTRON (Model No. 1122) tensile tester and the stretch release force measured by using a crosshead speed of 30 cm/min.

Table of Abbreviations

| Abbreviation/ Trade Designation | Description |
|---|---|
| ASPUN 6806 | Linear Low Density Polyethylene commerically available from Dow Chemical Company, Midland, MI |
| ENGAGE 8400 | Ethylene alpha-olefin copolymer commercially available from DuPont Dow Elastomers, Wilimington, DE |
| ESCOREZ 2393 | A hydrocarbon tackifier commercially available from Exxon Chemical Co., Houston, TX |
| EXACT 3040 | Ethylene-based hexene copolymer produced using a metallocene catalyst commercially available from Exxon Chemical Co., Houston, TX |
| EXACT 4023 | Ethylene/butylene copolymer produced using a metallocene catalyst commercially available from Exxon Chemical Co., Houston, TX |
| FINA 3960 | Polypropylene commercially available from the Fina Oil and Chemical Company, Dallas, TX |
| IOA/AA/Sty | Iso-Octyl Acrylate/Acrylic Acid/Styrene macromer terpolymer pressure sensitive adhesive (PSA) was prepared as described in Example 2 of U.S. Pat. No. 5,648,166 except that the IOA/AA/STY ratio was 92/4/4 and the inherent viscosity of the terpolymer was approximately 0.65 at a temperature of 24° C. |
| MORTHANE | A poly(esterurethane) resin, MORTHANE PS-440-200° C. commercially available from Morton Thiokol Corp. |
| PSA 1 | (77%) IOA/AA/Sty plus (23%) ESCOREZ 2393 |
| TAN | A pigment of pre-blended polyurethane (80%)/pigment (20%), commercially available as Product No.1093538 TAN, Reed Spectrum, Minneapolis, MN |

Example 1

A pressure sensitive adhesive containing minimicrofibrous reinforcing material was prepared from a mixture of 90% PSA 1 and 10% EXACT 4023. This preparation was extruded through a twin screw extruder manufactured by Brabender Corp. (BRABENDER PREP CENTER, available from C.W. Brabender Instruments, Inc., South Hackensack, N.J.) and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 10% polyethylene of the final adhesive composition. A nonwoven web with a basis weight of 75 grams per square meter (gsm or g/m$^2$) was collected on double-coated silicone release paper (DCP-Lohja Inc., Westchester, Ill.) using a rotating drum collector at a collector to die distance of 17.8 cm (7 inches).

Example 2

A pressure sensitive adhesive containing minimicrofibrous reinforcing material was prepared from a mixture of 80% PSA 1 and 20% EXACT 4023. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 20% polyethylene of the final adhesive composition. A nonwoven web with a basis weight of 75 gsm was collected on double-coated silicone release paper using a rotating drum collector at a collector to die distance of 17.8 cm (7 inches).

Example 3

A pressure sensitive adhesive containing minimicrofibrous reinforcing material was prepared from a mixture of 70% PSA 1 and 30% EXACT 4023. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 30% polyethylene of the final adhesive composition. A nonwoven web with a basis weight of 75 gsm was collected on double-coated silicone release paper using a rotating drum collector at a collector to die distance of 17.8 cm (7 inches).

Example 4

A pressure sensitive adhesive containing minimicrofibrous reinforcing material was prepared from a mixture of 90% PSA 1 and 10% EXACT 4023. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 10% polyethylene of the final adhesive composition. A nonwoven web with a basis weight of 55 gsm was collected on double-coated silicone release paper using a rotating drum collector at a collector to die distance of 17.8 cm (7 inches).

Example 5

A pressure sensitive adhesive containing minimicrofibrous reinforcing material was prepared from a mixture of 90% PSA 1 and 10% EXACT 4023. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 10% polyethylene of the final adhesive composition. A nonwoven web with a basis weight of 65 gsm was collected on double-coated silicone release paper using a rotating drum collector at a collector to die distance of 17.8 cm (7 inches).

Example 6

A pressure sensitive adhesive containing minimicrofibrous reinforcing material was prepared from a mixture of 85% PSA 1 and 15% EXACT 4023. This preparation was extruded through a twin screw extruder manufactured by Brabender Corp. and was fed to a drilled orifice melt-blown (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 15% polyethylene of the final adhesive composition. A nonwoven web with a basis weight of 55 gsm was collected on double-coated silicone release paper using a rotating drum collector at a collector to die distance of 17.8 cm (7 inches).

Example 7

A pressure sensitive adhesive containing minimicrofibrous reinforcing material was prepared from a mixture of 85% PSA 1 and 15% EXACT 4023. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 15% polyethylene of the final adhesive composition. A nonwoven web with a basis weight 65 gsm was collected on double-coated silicone release paper using a rotating drum collector at a collector to die distance of 17.8 cm (7 inches).

Example 8

A pressure sensitive adhesive containing minimicrofibrous reinforcing material was prepared from a mixture of 85% PSA 1 and 15% EXACT 4023. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 15% polyethylene of the final adhesive composition. A nonwoven web with a basis weight of 75 gsm was collected on double-coated silicone release paper using a rotating drum collector at a collector to die distance of 17.8 cm (7 inches).

Example 9

A pressure sensitive adhesive containing minimicrofibrous reinforcing material was prepared from a mixture of 90% PSA 1 and 10% EXACT 3040. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 10% polyethylene of the final adhesive composition. A nonwoven web with a basis weight of 55 gsm was collected on double-coated silicone release paper using a rotating drum collector at a collector to die distance of 17.8 cm (7 inches).

Example 10

A pressure sensitive adhesive containing minimicrofibrous reinforcing material was prepared from a mixture of 90% PSA 1 and 10% EXACT 3040. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 10% polyethylene of the final adhesive composition. A nonwoven web with a basis weight of 65 gsm was collected on double-coated silicone release paper using a rotating drum collector at a collector to die distance of 17.8 cm (7 inches).

Example 11

A pressure sensitive adhesive containing minimicrofibrous reinforcing material was prepared from a mixture of 83% PSA 1 and 17% EXACT 3040. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 17% polyethylene of the final adhesive composition. A nonwoven web with a basis weight of 55 gsm was collected on double-coated silicone release paper using a rotating drum collector at a collector to die distance of 17.8 cm (7 inches).

Example 12

A pressure sensitive adhesive containing minimicrofibrous reinforcing material was prepared from a mixture of 83% PSA 1 and 17% EXACT 3040. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 17% polyethylene of the final adhesive composition. A nonwoven web with a basis weight of 75 gsm was collected on double-coated silicone release paper using a rotating drum collector at a collector to die distance of 17.8 cm (7 inches).

Example 13

A pressure sensitive adhesive containing minimicrofibrous reinforcing material was prepared from a mixture of 75% PSA 1 and 25% EXACT 3040. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 25% polyethylene of the final adhesive composition. A nonwoven web with a basis weight of 55 gsm was collected on double-coated silicone release paper using a rotating drum collector at a collector to die distance of 17.8 cm (7 inches).

Example 14

A pressure sensitive adhesive containing minimicrofibrous reinforcing material was prepared from a mixture of 75% PSA 1 and 25% EXACT 3040. This preparation was extruded through a twin screw extruder manufactured by Brabender Corp. and was fed to a drilled orifice melt-blown die (each hole 0.4826 mm in diameter). The die was drilled with 5.9 holes per cm (15 holes per inch) and was maintained at a temperature of 190° C. The adhesive feeder was maintained at 190° C. while the polyethylene was fed in pellet form into the extruder to maintain 25% polyethylene of the final adhesive composition. A nonwoven web with a basis weight of 75 gsm was collected on double-coated silicone release paper using a rotating drum collector at a collector to die distance of 17.8 cm (7 inches).

Example 15

A pressure sensitive adhesive containing reinforcing material was prepared from a mixture of 85% PSA 1 was co-extruded with 15% ASPUN 6806 through a twin screw extruder manufactured by Brabender Corp. A nonwoven web from this preparation was prepared where each microfiber consisted of 3 alternating layers with the adhesive layers being on the outside. The multilayer nonwoven web was prepared using a process described in Example 1 of U.S. Pat. No. 5,258,220, except that a 3-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 85:15 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 16

A pressure sensitive adhesive containing reinforcing material was prepared from a mixture of 85% PSA 1 was co-extruded with 15% ASPUN 6806 through a twin screw extruder manufactured by Brabender Corp. A nonwoven web from this preparation was prepared where each microfiber consisted of 3 alternating layers with the adhesive layers being on the outside. The multilayer nonwoven web was prepared using a process described in Example 1 of U.S. Pat. No. 5,258,220, except that a 3-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 85:15 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 17

A pressure sensitive adhesive containing reinforcing material was prepared from a mixture of 90% PSA 1 was co-extruded with 10% EXACT 4023 through a twin screw extruder manufactured by Brabender Corp. A nonwoven web from this preparation was prepared where each microfiber consisted of 3 alternating layers with the adhesive layers being on the outside. The multilayer nonwoven web was prepared using a process described in Example 1 of U.S. Pat. No. 5,258,220, except that a 3-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 90:10 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 18

A pressure sensitive adhesive containing reinforcing material was prepared from a mixture of 85% PSA 1 was co-extruded with 15% EXACT 4023 through a twin screw extruder manufactured by Brabender Corp. A nonwoven web from this preparation was prepared where each microfiber consisted of 3 alternating layers with the adhesive layers being on the outside. The multilayer nonwoven web was prepared using a process described in Example 1 of U.S. Pat. No. 5,258,220, except that a 3-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 85:15 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 19

A pressure sensitive adhesive containing reinforcing material was prepared from a mixture of 80% PSA 1 was co-extruded with 20% EXACT 4023 through a twin screw extruder manufactured by Brabender Corp. A nonwoven web from this preparation was prepared where each microfiber consisted of 3 alternating layers with the adhesive layers being on the outside. The multilayer nonwoven web was prepared using a process described in Example 1 of U.S. Pat. No. 5,258,220, except that a 3-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 80:20 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 20

A pressure sensitive adhesive containing reinforcing material was prepared from a mixture of 90% PSA 1 was co-extruded with 10% ASPUN 6806 through a twin screw extruder manufactured by Brabender Corp. A nonwoven web from this preparation was prepared where each microfiber consisted of 5 alternating layers with the adhesive layers being on the outside. The multilayer nonwoven web was prepared using a process described in Example 1 of U.S. Pat. No. 5,258,220, except that a 5-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 90:10 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 21

A pressure sensitive adhesive containing reinforcing material was prepared from a mixture of 85% PSA 1 was co-extruded with 15% ASPUN 6806 through a twin screw extruder manufactured by Brabender Corp. A nonwoven web from this preparation was prepared where each microfiber consisted of 5 alternating layers with the adhesive layers being on the outside. The multilayer nonwoven web was prepared using a process described in Example 1 of U.S. Pat. No. 5,258,220, except that a 5-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 85:15 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 22

A pressure sensitive adhesive containing reinforcing material was prepared from a mixture of 90% PSA 1 was co-extruded with 10% EXACT 4023 through a twin screw extruder manufactured by Brabender Corp. A nonwoven web from this preparation was prepared where each microfiber consisted of 5 alternating layers with the adhesive layers being on the outside. The multilayer nonwoven web was prepared using a process described in Example 1 of U.S. Pat. No. 5,258,220, except that a 5-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 90:10 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 23

A pressure sensitive adhesive containing reinforcing material was prepared from a mixture of 85% PSA 1 was co-extruded with 15% EXACT 4023 through a twin screw extruder manufactured by Brabender Corp. A nonwoven web from this preparation was prepared where each microfiber consisted of 5 alternating layers with the adhesive layers being on the outside. The multilayer nonwoven web was prepared using a process described in Example 1 of U.S. Pat. No. 5,258,220, except that a 5-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 85:15 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 24

A pressure sensitive adhesive containing reinforcing material was prepared from a mixture of 90% PSA 1 was co-extruded with 10% ENGAGE 8400 through a twin screw extruder manufactured by Brabender Corp. A nonwoven web from this preparation was prepared where each microfiber consisted of 5 alternating layers with the adhesive layers being on the outside. The multilayer nonwoven web was prepared using a process described in Example 1 of U.S. Pat. No. 5,258,220, except that a 5-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 90:10 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 25

A pressure sensitive adhesive containing reinforcing material was prepared from a mixture of 85% PSA 1 was co-extruded with 15% ENGAGE 8400 through a twin screw extruder manufactured by Brabender Corp. A nonwoven web from this preparation was prepared where each microfiber consisted of 5 alternating layers with the adhesive layers being on the outside. The multilayer nonwoven web was prepared using a process described in Example 1 of U.S. Pat. No. 5,258,220, except that a 5-layer feedblock assembly. The extruder that delivered the tackified IOA/AA/Sty stream was kept at 190° C., and the extruder that delivered the polyethylene was kept at 200° C. The feedblock assembly and die were maintained at 200° C. The gear pumps were adjusted so that a 85:15 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 26

A pressure sensitive adhesive containing reinforcing material was prepared from a mixture of 90% PSA 1 was co-extruded with 10% EXACT 3040 through a twin screw extruder manufactured by Brabender Corp. A nonwoven web from this preparation was prepared where each microfiber consisted of 5 alternating layers with the adhesive layers being on the outside. The multilayer nonwoven web was prepared using a process described in Example 1 of U.S. Pat. No. 5,258,220, except that a 5-layer feedblock assembly. The extruder that delivered the tackified IOA/AA/Sty stream was kept at 190° C., and the extruder that delivered the polyethylene was kept at 220° C. The feedblock assembly and die were maintained at 200° C. The gear pumps were adjusted so that a 90:10 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 27

A pressure sensitive adhesive containing reinforcing material was prepared from a mixture of 85% PSA 1 was co-extruded with 15% EXACT 3040 through a twin screw extruder manufactured by Brabender Corp. A nonwoven web from this preparation was prepared where each microfiber consisted of 5 alternating layers with the adhesive layers being on the outside. The multilayer nonwoven web was prepared using a process described in Example 1 of U.S. Pat. No. 5,258,220, except that a 5-layer feedblock assembly. The extruder that delivered the tackified IOA/AA/Sty stream was kept at 190° C., and the extruder that delivered the polyethylene was kept at 220° C. The feedblock assembly and die were maintained at 220° C. The gear pumps were adjusted so that an 85:15 ratio of tackified adhesive to polyethylene was maintained. A nonwoven web with a basis weight of 65 gsm was collected on double-coated silicone release paper using a rotating drum collector at a collector to die distance of 17.8 cm (7 inches).

Example 28

A 46% portion of MORTHANE was trickle-blended with 4% TAN. The blend was co-extruded with a 50% of a 50:50 blend of EXACT 4023 and ASPUN 6806. A melt-blown web was prepared where each microfiber had 3 alternating layers with the polyurethane layers being on the outside. The multilayer melt-blown web was prepared using a process described in Example 1 of U.S. Pat. No. 5,258,220, except that a 3-layer feedblock assembly was used. The extruder that delivered the polyurethane stream was kept at about 220° C., and the extruder that delivered the PE blend was kept at 200° C. The feedblock assembly and die were maintained at 220° C. The gear pumps were adjusted so that a 50:50 ratio of polyurethane to polyethylene blend was maintained. A melt-blown web with a basis weight of 50 gsm was collected and wound onto a core with the collector distance from the die being about 12.7 cm (5 inches).

Example 29

A nonwoven web was prepared as described in Example 28, except that the basis weight of the web was 60 gsm.

Example 30

A nonwoven web was prepared as described in Example 29, except that the basis weight of the web was 75 gsm.

Example 31

An 80% portion of MORTHANE was co-extruded with a 20% portion of a 50:50 blend of EXACT 4023 and ASPUN 6806. A nonwoven web was prepared where each microfiber had 3 alternating layers with the polyurethane layers being on the outside. The multilayer nonwoven web was prepared using a process described in Example 1 of U.S. Pat. No. 5,258,220, except that a 3-layer feedblock assembly was used. The extruder that delivered the polyurethane stream was kept at about 220° C., and the extruder that delivered the PE blend was kept at 200° C. The feed block assembly and die were maintained at 220° C. The gear pumps were adjusted so that an 80:20 ratio of polyurethane to polyethylene blend was maintained. A nonwoven web with a basis weight of 100 gsm was collected and wound onto a core with the collector distance from the die being about 12.7 cm (5 inches).

Example 32

A nonwoven web was prepared as described in Example 31, except that the gear pumps were adjusted so that a 60:40 ratio of polyurethane to polyethylene was maintained.

Example 33

An 80% portion of MORTHANE was co-extruded with a 20% portion of a 60:40 blend of EXACT 4023 and ASPUN 6806. A nonwoven web was prepared where each microfiber had 3 alternating layers with the polyurethane layers being on the outside. The multilayer nonwoven web was prepared using a process described in Example 1 of U.S. Pat. No. 5,258,220, except that a 3-layer feedblock assembly was used. The extruder that delivered the polyurethane stream was kept at about 220° C., and the extruder that delivered the PE blend was kept at 200° C. The feedblock assembly and die were maintained at 220° C. The gear pumps were adjusted so that an 80:20 ratio of polyurethane to polyethylene blend was maintained. A nonwoven web with a basis weight of 100 gsm was collected and wound onto a core with the collector distance from the die being about 12.7 cm (5 inches).

Example 34

A nonwoven web was prepared as described in Example 33, except that the EXACT 4023 and ASPUN 6806 blend ratio was 80:20.

Example 35

A nonwoven web was prepared as described in Example 34, except that the gear pumps were adjusted so that a 40:60 ratio of polyurethane to polyethylene blend was maintained.

Example 36

A 60% portion of MORTHANE was co-extruded with a 40% portion of an 80:20 blend of EXACT 4023 and FINA 3960. A nonwoven web was prepared where each microfiber had 3 alternating layers with the polyurethane layers being on the outside. The multilayer nonwoven web was prepared using a process described in Example 1 of U.S. Pat. No. 5,258,220, except that a 3-layer feedblock assembly was used. The extruder that delivered the polyurethane stream was kept at about 220° C., and the extruder that delivered the polyethylene/polypropylene blend was kept at 200° C. The feedblock assembly and die were maintained at 220° C. The gear pumps were adjusted so that a 60:40 ratio of polyurethane to polyethylene/polypropylene blend was maintained. A nonwoven web with a basis weight of 100 gsm was collected and wound onto a core with the collector distance from the die being about 12.7 cm (5 inches).

Example 37

A 56% portion of MORTHANE was trickle-blended with 4% TAN. The blend was co-extruded with a 40% portion of a 40/60 blend of EXACT 4023 and ASPUN 6806. A nonwoven web was prepared where each microfiber had alternating layers of the polyurethane and the polyethylene blend in a side-by-side arrangement. The multilayer nonwoven web was prepared using a process described in Example 1 of U.S. Pat. No. 5,258,220, except that a 30-layer feedblock assembly was used. The extruder that delivered the polyurethane stream was kept at about 220° C. and the extruder that delivered the PE blend was kept at 200° C. The feedblock assembly and die were maintained at 220° C. The gear pumps were adjusted so that a 60:40 ratio of polyurethane to polyethylene blend was maintained. A nonwoven web with a basis weight of 105 gsm was collected and wound onto a core with the collector distance from the die being about 13.97 cm (5.5 inches).

Example 38

A nonwoven web was prepared as described in Example 37, except that the gear pumps were adjusted so that a 50:50 ratio of polyurethane to polyethylene blend was maintained.

Example 39

A nonwoven web was prepared as described in Example 37, except that the blend of EXACT 4023 and ASPUN 6806 was at a 60:40 ratio, and the gear pumps were adjusted so that a 75:25 ratio of polyurethane to polyethylene blend was maintained.

Example 40

A nonwoven web was prepared as described in Example 37, except that the gear pumps were adjusted so that a 25:75 ratio of polyurethane to polyethylene blend was maintained.

Example 41

A pressure sensitive adhesive containing minimicrofibrous reinforcing material was prepared from a mixture of 85% PSA 1 and 15% EXACT 4023. This preparation was extruded through a twin screw extruder manufactured by Brabender Corp. and was fed to a drilled orifice melt-blown die. The die was drilled with 5.9 holes per cm (15 holes per inch) and was maintained at a temperature of 190° C. The adhesive feeder was maintained at 190° C. while the polyethylene was fed in pellet form into the extruder to maintain a 15% level of the overall blended PSA. A nonwoven web with a basis weight of 25 gsm was collected on double-coated silicone release paper using a rotating drum collector at a collector to die distance of approximately 17.8 cm (7 inches).

Example 42

A nonwoven PSA web was prepared as described in Example 41, except that the basis weight of the adhesive was 35 gsm.

Example 43

A nonwoven PSA web was prepared as described in Example 41, except that the basis weight of the adhesive was 45 gsm.

Example 44

A stretch removable adhesive article was constructed as follows. A nonadhesive web described in Example 28 was placed on the adhesive web described in Example 43 and covered with a release liner. This construction was then passed between two 41.9 cm (16.5 inch) heated rubber rolls rotating at 11.4 cm (4.5 feet) per minute where the top roll was maintained at 260° C. and the bottom roll was maintained at 230° C. The nonadhesive web side was exposed to the higher roll temperature during lamination of the web to the adhesive. The air supply to the rubber rolls was maintained at 11.6 kPa. Average Stretch Release Force is shown in Table 3, which demonstrated that the article was removable.

Example 45

A stretch removable adhesive article was constructed as follows. A nonadhesive web described in Example 29 was placed on the adhesive web described in Example 43 and covered with a release liner. This construction was then passed between two 41.9 cm (16.5 inch) heated rubber rolls rotating at 11.4 cm (4.5 feet) per minute where the top roll was maintained at 260° C. and the bottom roll was maintained at 230° C. The nonadhesive web side was exposed to the higher roll temperature during lamination of the web to the adhesive. The air supply to the rubber rolls was maintained at 11.6 kPa. Average Stretch Release Force is shown in Table 3, which demonstrated that the article was removable.

Example 46

A stretch removable adhesive article was constructed as follows. A nonadhesive web described in Example 30 was placed on the adhesive web described in Example 43 and covered with a release liner. This construction was then passed between two 41.9 cm (16.5) inch heated rubber rolls rotating at 11.4 cm (4.5 feet) per minute where the top roll was maintained at 260 C and the bottom roll was maintained at 230° C. The nonadhesive web side was exposed to the higher roll temperature during lamination of the web to the adhesive. The air supply to the rubber rolls was maintained at 11.6 kPa. Average Stretch Release Force is shown in Table 3, which demonstrated that the article was removable.

Example 47

A stretch removable adhesive article was constructed as follows. A nonadhesive web described in Example 29 was placed on the adhesive web described in Example 41 and covered with a release liner. This construction was then passed between two 41.9 cm (16.5 inch) heated rubber rolls rotating at 11.4 cm (4.5 feet) per minute where the top roll was maintained at 260° C. and the bottom roll was maintained at 230° C. The nonadhesive web side was exposed to the higher roll temperature during lamination of the web to the adhesive. The air supply to the rubber rolls was maintained at 11.6 kPa. Average Stretch Release Force is shown in Table 3, which demonstrated that the article was removable.

Example 48

A stretch removable adhesive article was constructed as follows. A nonadhesive web described in Example 30 was placed on the adhesive web described in Example 41 and covered with a release liner. This construction was then passed between two 41.9 cm (16.5 inch) heated rubber rolls rotating at 11.4 cm (4.5 feet) per minute where the top roll was maintained at 260° C. and the bottom roll was maintained at 230° C. The nonadhesive web side was exposed to the higher roll temperature during lamination of the web to the adhesive. The air supply to the rubber rolls was maintained at 11.6 kPa. Average Stretch Release Force is shown in Table 3, which demonstrated that the article was removable.

Example 49

A stretch removable adhesive article was constructed as follows. A nonadhesive web described in Example 29 was placed on the adhesive web described in Example 6 and covered with a release liner. This construction was then passed between two 41.9 cm (16.5 inch) heated rubber rolls rotating at 11.4 cm (4.5 feet) per minute where the top roll was maintained at 260° C. and the bottom roll was maintained at 230° C. The nonadhesive web side was exposed to the higher roll temperature during lamination of the web to the adhesive. The air supply to the rubber rolls was maintained at 11.6 kPa. Average Stretch Release Force is shown in Table 3, which demonstrated that the article was removable.

TABLE 1

Mechanical Properties of Pressure Sensitive Adhesive Nonwoven Webs

| Example | Adhesive Maximum Load (g/cm) | | Adhesive Elongation at Break (%) | | Crosshead Speed (cm/min) |
|---|---|---|---|---|---|
| | MD | CD | MD | CD | |
| 1 | 88 | 56 | 572 | 628 | 25 |
| 2 | 88 | 73 | 529 | 652 | 25 |
| 3 | 112 | 87 | 480 | 463 | 25 |
| 4 | 63 | — | 530 | — | 30 |
| 5 | 68 | — | 540 | — | 30 |
| 6 | 69 | — | 560 | — | 30 |
| 7 | 75 | — | 540 | — | 30 |
| 8 | | — | 520 | — | 30 |
| 9 | 56 | — | 500 | — | 30 |
| 10 | 68 | — | 580 | — | 30 |
| 11 | 72 | — | 490 | — | 30 |
| 12 | | — | 580 | — | 30 |
| 13 | 118 | — | 480 | — | 30 |
| 14 | 154 | — | 510 | — | 30 |
| 17 | 74 | 56 | 663 | 394 | 25 |
| 18 | 94 | 68 | 625 | 583 | 25 |
| 22 | 81 | 61 | 659 | 486 | 25 |
| 23 | 88 | 72 | 629 | 551 | 25 |

TABLE 2

Mechanical Properties of Nonadhesive Webs for Backings

| Example | Nonadhesive Maximum Load (kg/cm) | | Nonadhesive Elongation at Break (%) | | Permanent Set (%) | |
|---|---|---|---|---|---|---|
| | MD | CD | MD | CD | MD | CD |
| 31 | 0.7 | 0.5 | 433 | 448 | 25 | 27 |
| 32 | 0.5 | 0.6 | 292 | 431 | 36 | 37 |
| 33 | 0.8 | 0.6 | 432 | 459 | 20 | 20 |
| 34 | 0.8 | 0.7 | 454 | 457 | 15 | 17 |
| 35 | 0.6 | 0.5 | 457 | 491 | 22 | 24 |
| 36 | 0.5 | 0.4 | 329 | 333 | 23 | 27 |
| 37 | 1.1 | 0.7 | 704 | 753 | 39 | 34 |
| 38 | 1.0 | 0.7 | 725 | 752 | 29 | 30 |
| 39 | — | — | | — | 18 | 18 |
| 40 | — | — | | — | 34 | 34 |

Crosshead speed was 5 cm/min for Maximum Load at Break and Elongation at Break. Crosshead speed was 25 cm/min for Permanent Set.

TABLE 3

Stretch Removable Adhesive Article Force Data

| Example | Average Stretch Release Force (g/cm) |
|---|---|
| 44 | 293 |
| 45 | 304 |
| 46 | 343 |
| 47 | 261 |
| 48 | 293 |
| 49 | 341 |

Crosshead speed was 30 cm/min.

TABLE 4

Mechanical Properties of Pressure Sensitive Adhesive Nonwoven Webs

| Ex. | Adhesive Load at Yield Point MD (g/cm) | Adhesive Maximum Load MD (g/cm) | Adhesive Load at Yield Point CD (g/cm) | Adhesive Maximum Load CD (g/cm) | % Maximum Load of the Load at Yield Point MD |
|---|---|---|---|---|---|
| 4 | 10 | 63 | 9 | 50 | 630% |
| 5 | 11 | 68 | 11 | 56 | 618% |
| 6 | 16 | 69 | 14 | 50 | 431% |
| 7 | 16 | 75 | 13 | 64 | 469% |
| 9 | 14 | 56 | 12 | 64 | 400% |
| 10 | 16 | 68 | 13 | 70 | 425% |
| 11 | 21 | 72 | 17 | 75 | 343% |
| 13 | 34 | 118 | 23 | 91 | 347% |
| 14 | 54 | 154 | 29 | 93 | 285% |

Crosshead speed was 30 cm/min for Load and Elongation at Break

The complete disclosures of the patents, patent documents, and publications cited herein are incorporated by reference in their entirety as if each were individually incorporated. Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows.

What is claimed is:

1. An adhesive nonwoven web comprising pressure sensitive adhesive fibers, wherein the pressure sensitive adhesive fibers comprise:

a pressure sensitive adhesive component; and an organic polymeric reinforcing material comprising a plurality of substantially continuous minimicrofibers having a diameter of no greater than about 10 microns within the pressure sensitive adhesive component;

wherein the pressure sensitive adhesive fibers comprise about 60 weight percent to about 95 weight percent of the pressure sensitive adhesive component and about 5 weight percent to about 40 weight percent of minimicrofibrous organic polymeric reinforcing material based on a total weight of the pressure sensitive adhesive fibers, and further wherein a nonwoven web comprising the pressure sensitive adhesive fibers and having a basis weight of about 55 g/m$^2$ has a maximum load of at least about 30 g/cm, which is at least about 150% of the load at yield point, and an elongation at break of at least about 50%.

2. The nonwoven web of claim 1 wherein the minimicrofibrous organic polymeric reinforcing material comprises substantially continuous in-situ formed minimicrofibers.

3. The nonwoven web of claim 1 which has an elongation at break of at least about 200% at a basis weight of about 55 g/m$^2$.

4. The nonwoven web of claim 1 which has a maximum load of at least about 50 g/cm at a basis weight of about 55 g/m$^2$.

5. The nonwoven web of claim 1 which has a load at yield point of no greater than about 100 g/cm at a basis weight of about 55 g/$^2$.

6. The nonwoven web of claim 1 comprising about 60 weight percent to about 95 weight percent of the pressure sensitive adhesive component and about 5 weight percent to about 40 weight percent of minimicrofibrous organic polymeric reinforcing material.

7. The nonwoven web of claim 1 wherein the minimicrofibers have a diameter of no greater than about 5 micrometers.

8. The nonwoven web of claim 1 wherein the minimicrofibers have an aspect ratio of greater than about 1000.

9. The nonwoven web of claim 1 wherein the pressure sensitive adhesive component comprises synthetic rubber, styrene block copolymer, polyvinyl ether, poly(meth)acrylate, polyolefin, silicone, or combinations thereof.

10. The nonwoven web of claim 1 wherein the pressure sensitive adhesive component comprises a crosslinked acrylate copolymer, wherein the crosslinked acryl ate copolymer comprises copolymerized monomers comprising at least one monoethylenically unsaturated alkyl (meth)acrylate monomer, at least one monoethylenically unsaturated free-radically copolymerizable reinforcing monomer having a homopolymer glass transition temperature higher than that of the alkyl (meth)acrylate monomer.

11. The nonwoven web of claim 10 wherein the crosslinked acrylate copolymer is derived from a melt-processable acrylate copolymer and a crosslinking agent, wherein the crosslinking agent crosslinks subsequent to fiber formation or is a thermally reversible crosslinking agent.

12. The nonwoven web of claim 11 wherein the crosslinking agent is a styrene macromer.

13. The nonwoven web of claim 10 wherein the alkyl (meth)acrylate monomer when homopolymerized has a glass transition temperature of no greater than about 0° C., and wherein the free-radically copolymerizable reinforcing monomer when homopolymerized has a glass transition temperature of at least about 10° C.

14. The nonwoven web of claim 10 wherein the pressure sensitive adhesive component comprises a polymer derived from at least one alkyl (meth)acrylate ester monomer; the group consisting of selected from isooctyl acrylate, 2-ethylhexyl acrylate, and n-butyl acrylate, and at least one monomer selected from the group consisting of acrylic acid and acrylamide.

15. The nonwoven web of claim 1 wherein the minimicrofibrous organic polymeric reinforcing material comprises an elastomer having a yield strength of no greater than about 20 MPa and a tensile strength of at least about 150% of the yield strength.

16. The nonwoven web of claim 1 wherein the minimicrofibrous organic polymeric reinforcing material comprises a semi-crystalline polymer.

17. An article comprising a surface having the adhesive nonwoven web of claim 1 disposed thereon.

18. A stretch removable article comprising the adhesive nonwoven web of claim 1.

19. A medical article comprising the adhesive nonwoven web of claim 1.

20. The medical article of claim 19 which is in the form of a wound dressing, surgical dressing, medical tape, athletic tape, or surgical tape.

21. The medical article of claim 19 which is in the form of a sensor, an electrode, or an ostomy appliance.

22. An adhesive nonwoven web comprising pressure sensitive adhesive fibers, wherein the pressure sensitive adhesive fibers comprise:

a pressure sensitive adhesive component; and a reinforcing material comprising a metallocene-catalyzed polyolefin within the pressure sensitive adhesive component;

wherein the reinforcing material comprises a plurality of substantially continuous minimicrofibers having a diameter of no greater than about 10 microns;

wherein the pressure sensitive adhesive fibers comprise about 60 weight percent to about 95 weight percent of the pressure sensitive adhesive component and about 5 weight percent to about 40 weight percent of the reinforcing material based on a total weight of the pressure sensitive adhesive fibers, and further wherein a nonwoven web comprising the pressure sensitive adhesive fibers and having a basis weight of about 55 $g/m^2$ has a maximum load of at least about 30 g/cm, which is at least about 150% of the load at yield point, and an elongation at break of at least about 50%.

23. The nonwoven web of claim 22 wherein the reinforcing material has a melting point above the use temperature of the fiber.

24. An article comprising a surface having the adhesive nonwoven web of claim 22 disposed thereon.

25. A stretch removable article comprising the adhesive nonwoven web of claim 22.

26. A medical article comprising the adhesive nonwoven web of claim 22.

27. An adhesive nonwoven web comprising pressure sensitive adhesive fibers, wherein the pressure sensitive adhesive fibers comprise:

a pressure sensitive adhesive component comprising a crosslinked acrylate copolymer, wherein the crosslinked acrylate copolymer comprises copolymerized monomers comprising at least one monoethylenically unsaturated alkyl (meth)acrylate monomer, at least one monoethylenically unsaturated free-radically copolymerizable reinforcing monomer having a homopolymer glass transition temperature higher than that of the alkyl (meth)acrylate monomer; and a reinforcing material comprising a metallocene-catalyzed polyolefin within the pressure sensitive adhesive component;

wherein the reinforcing material comprises a plurality of substantially continuous minimicrofibers having a diameter of no greater than about 10 microns;

wherein the pressure sensitive adhesive fibers comprise about 60 weight percent to about 95 weight percent of the pressure sensitive adhesive component and about 5 weight percent to about 40 weight percent of the reinforcing material based on a total weight of the pressure sensitive adhesive fibers, and further wherein a nonwoven web comprising the pressure sensitive adhesive fibers and having a basis weight of about 55 $g/m^2$ has a maximum load of at least about 30 g/cm, which is at least about 150% of the load at yield point, and an elongation at break of at least about 50%.

28. An article comprising a surface having the adhesive nonwoven web of claim 27 disposed thereon.

29. A stretch removable article comprising the adhesive nonwoven web of claim 27.

30. A medical article comprising the adhesive nonwoven web of claim 27.

31. An adhesive nonwoven web comprising pressure sensitive adhesive fibers, wherein the pressure sensitive adhesive fibers comprise:

a pressure sensitive adhesive component; and an organic polymeric reinforcing material within the pressure sensitive adhesive component, wherein the organic polymeric reinforcing material has a yield strength of no greater than about 20 MPa and an elongation at break of at least about 50%;

wherein the reinforcing material comprises a plurality of substantially continuous minimicrofibers having a diameter of no greater than about 10 microns;

wherein the pressure sensitive adhesive fibers comprise about 60 weight percent to about 95 weight percent of the pressure sensitive adhesive component and about 5 weight percent to about 40 weight percent of the organic polymeric reinforcing material based on a total weight of the pressure sensitive adhesive fibers, and further wherein a nonwoven web comprising the pressure sensitive adhesive fibers and having a basis weight of about 55 $g/m^2$ has a maximum load of at least about 30 g/cm, which is at least about 150% of the load at yield point, and an elongation at break of at least about 50%.

32. An article comprising a surface having the adhesive nonwoven web of claim 31 disposed thereon.

33. A stretch removable article comprising the adhesive nonwoven web of claim 31.

34. A medical article comprising the adhesive nonwoven web of claim 31.

* * * * *

UNITED STATES PATENT AND TRADEMARK OFFICE

CERTIFICATE OF CORRECTION

PATENT NO. : 6,994,904 B2
APPLICATION NO. : 09/847942
DATED : February 7, 2006
INVENTOR(S) : Eugene G. Joseph It is certified that error appears in the above-identified patent and that said Letters Patent is hereby corrected as shown below:

Page 2

Column 1, under "Other Publications", line 2, delete "Co.,ltd.," and insert -- Co., Ltd., --, therefor.

Column 1, under "Other Publications", line 10, delete ">http:" and insert -- <http: --, therefor.

Column 1, under "Other Publications", line 11, delete "manufactuing" and insert -- manufacturing --, therefor.

Column 1, under "Other Publications", line 16, delete ">http:" and insert -- <http: --, therefor.

Column 1, under "Other Publications", line 19, delete "Co.,ltd.," and insert -- Co., Ltd., --, therefor.

Column 2, under "Other Publications", line 17, delete "<http: //office" and insert -- http: //office --, therefor.

Column 1

Line 55, delete "pre-reated" and insert -- pre-treated --, therefor.

Column 6

Line 63, delete "adhesive" and insert -- Adhesive --, therefor.

Column 11

Line 67, delete "5,348,455" and insert -- 5,248,455 --, therefor.

Column 16

Line 22, delete "commerically" and insert -- commercially --, therefor.

UNITED STATES PATENT AND TRADEMARK OFFICE

CERTIFICATE OF CORRECTION

PATENT NO. : 6,994,904 B2
APPLICATION NO. : 09/847942
DATED : February 7, 2006
INVENTOR(S) : Eugene G. Joseph It is certified that error appears in the above-identified patent and that said Letters Patent is hereby corrected as shown below:

Column 30

Line 12, in Claim 5, delete "55 $g/^2$." and insert -- 55 g/m2. --, therefor.

Line 29, In Claim 10, delete "acryl ate" and insert -- acrylate --, therefor.

Signed and Sealed this

Twelfth Day of June, 2007

JON W. DUDAS

*Director of the United States Patent and Trademark Office*